US012241163B2

(12) United States Patent
Baas

(10) Patent No.: US 12,241,163 B2
(45) **Date of Patent: *Mar. 4, 2025**

(54) METHOD FOR PATINATING ZINC SURFACES AND SYSTEM THEREFOR

(71) Applicant: AQUACARE EUROPE B.V., S-Hertogenbosch (NL)

(72) Inventor: Koos Jan Baas, Wellington, FL (US)

( * ) Notice: Subject to any disclaimer, the term of this patent is extended or adjusted under 35 U.S.C. 154(b) by 743 days.

This patent is subject to a terminal disclaimer.

(21) Appl. No.: 17/417,033

(22) PCT Filed: Dec. 20, 2019

(86) PCT No.: PCT/NL2019/050868
§ 371 (c)(1),
(2) Date: Jun. 21, 2021

(87) PCT Pub. No.: WO2020/130833
PCT Pub. Date: Jun. 25, 2020

(65) Prior Publication Data

US 2022/0074037 A1 Mar. 10, 2022

(30) Foreign Application Priority Data

Dec. 21, 2018 (NL) ..... 2022279

(51) Int. Cl.
*C23C 8/28* (2006.01)
*C23C 2/00* (2006.01)
(Continued)

(52) U.S. Cl.
CPC ..... *C23C 8/34* (2013.01); *C23C 2/26* (2013.01); *C23C 2/261* (2022.08); *C23C 2/51* (2022.08);
(Continued)

(58) Field of Classification Search
None
See application file for complete search history.

(56) References Cited

U.S. PATENT DOCUMENTS 6,231,686 B1 5/2001 Eierman
2007/0289966 A1* 12/2007 Morrison ..... B05D 7/54 220/62.22
(Continued)

FOREIGN PATENT DOCUMENTS

EP 2371984 A1 10/2011
EP 3211113 A1 * 8/2017
(Continued)

OTHER PUBLICATIONS

David Lindstrom; Inger Odnevall Wallinder, Long-term use of galvanized steel in external applications. Aspects of patina formation, zinc runoff, barrier properties of surface treatments, and coatings and environmental fate, Feb. 2011; 173(1-4): 139-53; PubMed.

*Primary Examiner* — George Wyszomierski
(74) *Attorney, Agent, or Firm* — Derek Fahey, Esq.; The Plus IP Firm, PLLC

(57) ABSTRACT

The invention relates to a method for patinating zinc surfaces of a structural element, including the steps of: providing a structural element with a zinc surface in a housing; providing an atmosphere around the zinc surface, wherein said atmosphere comprises carbon based gas and humidity; and heating the zinc surface for at least one hour, to provide a patinated zinc surface. The heating of the zinc surface occurs by heating the atmosphere to a temperature of at least 50° C., the humidity is at least 70%, and the carbon-based gas concentration is at least 5% by volume. The invention also relates to a patinated evaporative condenser in a closed-circuit cooling tower The patinated evaporative condenser in a closed-circuit cooling tower is by the method according to the invention. A system for patinating zinc surfaces according to the invention is also disclosed.

14 Claims, 11 Drawing Sheets

(51) Int. Cl.

| | |
|---|---|
| ***C23C 2/26*** | (2006.01) |
| ***C23C 8/02*** | (2006.01) |
| ***C23C 8/34*** | (2006.01) |
| ***C23C 28/00*** | (2006.01) |

(52) U.S. Cl.
CPC ..... *C23C 2/52* (2022.08); *C23C 8/02* (2013.01); *C23C 8/28* (2013.01); *C23C 28/3225* (2013.01)

(56) References Cited

U.S. PATENT DOCUMENTS

| | | | | |
|---|---|---|---|---|
| 2010/0032573 | A1* | 2/2010 | Shelley ..... | G01N 21/3563 250/341.8 |
| 2010/0304184 | A1 | 12/2010 | Gall | |
| 2021/0017652 | A1 | 1/2021 | Mourier | |

FOREIGN PATENT DOCUMENTS

| | | | |
|---|---|---|---|
| WO | 2017144721 | A1 | 2/2017 |
| WO | 2020130833 | A1 | 6/2020 |

* cited by examiner

METHOD FOR PATINATING ZINC SURFACES AND SYSTEM THEREFOR

CROSS-REFERENCE TO RELATED APPLICATIONS

This application is a national stage application, filed under 35. U.S.C. § 371, of International Patent Application No. PCT/NL2019/050868, filed on Dec. 20, 2019 which is incorporated by reference herein its entirety, and which claims priority to NL2022279, filed Dec. 21, 2018.

TECHNICAL FIELD

The present invention relates to a method for patinating zinc surfaces and system therefor.

BACKGROUND

Metal surfaces, especially iron/steel surfaces, are known to be sensible to rust. In order to prevent the metal surfaces from rusting the surfaces are often coated. The coating layer can, for example, be coated with another metal which forms a protective layer such as zinc. The protective (metal) layer is often reactive and can form a passivation layer which protects the surface.

Passivation is the process in which the protective metal layer forms a metal oxide layer. It is known that a passivation layer of, for example, zinc requires time to form when the coated surface is exposed to the outside environment. Usually this (natural) process takes about 6-8 weeks. This is a disadvantage of exposing the (zinc) coated surface to the outside environment.

The passivation of the protective metal layer can also be chemically induced. A disadvantage of this methodology is the use of toxic chemicals such as chrome (or chrome comprising compounds). Therefore, such a method is undesired and in many countries the use of chrome (or chrome comprising compounds) is restricted.

The protective layer formed during the passivation process comprises zinc carbonate ($ZnCO_3$) and is referred to as penta zinc hydroxy di-carbonate. Furthermore, the passivation process requires carbon dioxide from the outside environment. The slow process of passivation in an outside environment is a direct consequence of the fact that outside air has low levels of carbon dioxide. The so called 'white rust', which can be formed has been known for many decades and appears under moist circumstances in an early stage.

SUMMARY

The method according to the invention is aimed at obviating or at least reduce the abovementioned disadvantages.

To that end, the invention provides a method for patinating zinc surfaces of a structural element, comprising the steps of:

- providing a structural element with a zinc surface in a housing;
- providing an atmosphere around the zinc surface, wherein said atmosphere comprises carbon based gas and humidity; and
- heating the zinc surface for at least one hour, to provide a patinated zinc surface,
- wherein the heating of the zinc surface occurs by heating the atmosphere to a temperature of at least 50° C., the humidity is at least 70%, and the carbon based gas concentration is at least 5% by volume.

It should be noted that, for the purpose of the invention, patinating is providing a protective covering to materials that would otherwise be damaged by corrosion or weathering.

The chemical reaction performed in the patination process follows for example the reactions as shown below, wherein Zn is zinc, $O_2$ is oxygen, ZnO is zinc oxide, $Zn(OH)_2$ is zinc hydroxide, $CO_2$ is carbon dioxide, $H_2O$ is water and $ZnCO_3$ is zinc carbonate:

$$2Zn+O_2 \rightarrow 2ZnO$$

$$ZnO+H_2O \rightarrow Zn(OH)_2$$

$$Zn(OH)_2+CO_2 \rightarrow H_2O+ZnCO_3$$

In a most preferred embodiment according to the invention, the formed patina layer as penta zinc hydroxy di-carbonate ($Zn_5(CO_3)_{2-X}\cdot(OH)_{6+2X}$ or PZHC) and is a tight protection outer layer which reduces or overcomes corrosion, wherein X is $0 \leq X \leq 2$, preferably wherein X is $0 \leq X \leq 1$, or even wherein X is $0 \leq X \leq 0.5$.

Carbon dioxide is an example of carbon based gasses. It will be understood that other carbon based gasses can be utilised.

The metal surface is initially coated with zinc. This can be achieved by hot-dipping, electro-galvanization and/or sherardizing. The zinc layer is a reactive zinc layer and can form zinc oxide when exposed to oxygen. Zinc oxide will react with water to form zinc hydroxide. Zinc hydroxide reacts with carbon dioxide to form zinc carbonate.

It should be noted that, for the purpose of the invention, a condenser element can be used in an evaporative condenser, condenser or closed circuit cooler. This terminology can be used interchangeably.

The method according to the invention provides several advantages over the prior art.

Contrary to conventional methods for providing a patina layer to a zinc surface is that the zinc surface is provided with a carbon based gas with a concentration of at least 5% by volume. This will help to increase the speed of the patinating process. As a result, the patinating process is not limiting the chain from manufacturer to end user. In particular, the chain from manufacturer to end user is not limited in time.

Another advantage of the method according to the invention is that the conditions of the patination process are constant and controlled. As a result the patina layer has a uniform and homogeneous structure. Furthermore, the patina layer comprises a reduced amount of defects compared to a passivation or patina layer obtained by exposing the zinc surface to the outside environment. A more homogeneous layer increases the possibility to patinate thicker layers of zinc carbonate. Therefore, the patina layer provided to the metal surface has a longer lasting protection.

Yet another advantage of the method according to the invention is that the applied heat is at least 50° C. and will accelerate the forming of zinc carbonate. As a result, a relatively short period of time is required to form a zinc carbonate layer. Thus, the time to patinate the zinc coated surface is significantly decreased and is no longer a limiting factor in the production process of patinated zinc surfaces.

Yet another advantage of the method according to the invention is that the humidity is at least 70% and will accelerate the forming of zinc carbonate. As a result zinc oxide can react to form zinc hydroxide, wherein the reaction is not limited to the availability of water.

In a preferred embodiment according to the invention, the carbon based gas is of the group carbon dioxide, carbon monoxide, or a mixture thereof, preferably wherein the carbon based gas is carbon dioxide.

An advantage of the method according to the invention is that the carbon based gas can form zinc carbonate. Preferably carbon dioxide, carbon monoxide or a mixture thereof is used to form zinc carbonate. This results in an effective protection of the metal surface. Furthermore, carbon monoxide and carbon dioxide are readily available and are efficient reagents to form zinc carbonate. Carbon dioxide is preferred over carbon monoxide or a mixture of carbon monoxide and carbon dioxide. Carbon dioxide is readily available and is less toxic/harmful at high concentrations compared to carbon monoxide.

In a further preferred embodiment according to the invention, the carbon based gas concentration is at least 7% by volume, preferably the carbon based gas concentration is at least 10% by volume, more preferably the carbon based gas concentration is at least 15% by volume, even more preferably the carbon based gas concentration is at least 20% by volume, most preferably the carbon based gas concentration is at least 25% by volume.

An advantage of the method according to the invention is that high concentrations of the carbon based gas accelerate the formation of zinc carbonate, and even the highly desired penta zinc hydroxy di-carbonate ($Zn_5(CO_3)_{2-X}\cdot(OH)_{6+2X}$ or PZHC), with X as specified above. As a result the production time of patinated metal surfaces decreases. Therefore, delivery of objects with a patinated metal surface to potential customers is reduced.

A further advantage of the method according to the invention is it provides a patina layer with a uniform and homogeneous structure. Furthermore, the patina layer comprises a reduced amount of defects compared to a passivation or patina layer obtained by exposing the zinc surface to the outside environment. As a result of the more homogeneous layer a thicker layer comprising zinc carbonate, such as PZHC, can be formed. Therefore, the patina layer provided to the metal surface has a longer lasting protection. In a preferred embodiment, the carbon based gas concentration is at most 50% by volume, preferably wherein the carbon based gas concentration is at most 30% by volume, more preferably wherein the carbon based gas concentration is in the range of 5% to 30% by volume, most preferably wherein the carbon based gas concentration is in the range of 15% to 30% by volume.

Performing the patination with the carbon gas concentration being at most 50% by volume results in an uniform and homogeneous structure. Furthermore, the carbon gas concentration of at most 50% by volume, preferably wherein the carbon based gas concentration is at most 30% by volume, more preferably wherein the carbon based gas concentration is in the range of 5% to 30% by volume, most preferably wherein the carbon based gas concentration is in the range of 15% to 30% by volume results in an efficient and effective patination process. Higher concentrations of the carbon based gas are not cost effective and therefore undesired.

In an even further preferred embodiment according to the invention, the heating occurs at a temperature of at least 60° C., preferably the heating occurs at a temperature of at least 70° C., more preferably the heating occurs at a temperature of at least 80° C.

Performing the heating at a temperature of at least 60° C., preferably a temperature of at least 70° C., more preferably a temperature of at least 80° C. results in a stable patination and thus a patina layer with a uniform and homogeneous structure. Furthermore, the heat vaporises the water which is released in the patination process. The vaporised water will then contribute to the humidity level.

Experiments showed that performing the heating at a temperature of at least 80° C. results in a stable patination and a patination layer with a uniform and homogeneous structure.

In an even further preferred embodiment according to the invention, the humidity is at least 75%, preferably the humidity is at least 78%, more preferably the humidity is at least 80%.

An advantage of the method according to the invention is that a humidity level of at least 75%, preferably of at least 78%, more preferably of at least 80% accelerates the formation of zinc hydroxide. As a result the patination process is not limited to the formation of zinc hydroxide and thus an efficient method for patinating a zinc surface is achieved.

The humidity is given as the relative humidity (RH) and describes the amount of water vapour present in the gas mixture provided to the zinc surface.

In an even further preferred embodiment according to the invention, the heating occurs for at least two hours, preferably the heating occurs for at least three hours, more preferably the heating occurs for at least four hours. By further preference the heating occurs for at most ten hours.

An advantage of the method according to the invention is that heating the zinc coated surface accelerates the formation of zinc carbonate. Furthermore, the heat provides in a stable humidity level. As a result, an efficient and effective patination method is achieved.

Preferably, the patination process is performed with the heating occurring for at least two, preferably for at least three hours, more preferably the heating occurs for at least four hours, and wherein the carbon gas concentration is in the range of 15% to 30% by volume. It was surprisingly found that such method provided an efficient and effective patination layer, wherein the patination layer is uniform and homogeneous.

In a preferred embodiment the method comprises the steps of heating, wherein the heating occurs at a temperature of at least 80° C., providing an atmosphere around the zinc surface, wherein the carbon based gas concentration is at most 20% by volume and the humidity is at least 70%, and wherein the heating is occurs for at least four hours.

Experiments showed that applying such parameters an effective and efficient patination layer was achieved. The achieved patination layer comprises a uniform and homogeneous structure.

In an even further preferred embodiment according to the invention, the method comprises the step of providing a structural element with a zinc surface to an object of the application prior to the step of providing a structural element with a zinc surface in a housing. In other words, the structural element is assembled to other elements, so as to assemble the object, prior to the patination steps (which include the provision of the structural element into the housing, the provision of the specified atmosphere and the heating as specified in the method according to the invention).

An advantage of the method according to the invention is that the patination can be performed on site and inside the object of the application. Thus, the structural element is assembled into the object of the intended application and only thereafter patinated. Preferably, the entire object is concealed within the housing. Alternatively, the housing can be an external enclosure of the object itself. This leads to less maintenance and effective and efficient patination. The 'weak' spots, like connection elements, can be provided with a patination layer without defects.

One preferred object is a condenser or closed circuit cooler in a cooling tower. The one or more of the structural elements of the condenser or closed circuit cooler are condensing elements such as pipes, grids and/or plates and the like.

An extra effect of the method according to the invention is that the method renders it possible to patinate the zinc surface in the housing and to prevent weak spots of the patinated object, which are conventionally due to installation. Patinated/coated objects are prone to develop weak spots at the places connection means are attached. Connection means are for example holes (for screws), screws, nails and the like. Due to the assembly prior to patination, the patinated zinc surface extends to grooves, holes and surfaces that otherwise would be exposed. Moreover, this method further allows, in one specific implementation, that the patinated zinc surface also extends onto connection means. This specific implementation involves, in a most preferred version, the coating of the connection means with zinc prior to patination. By coating the connection means with zinc prior to patination, patinated surfaces last longer and require less replacement and/or maintenance. Furthermore, the connection means are firmer connected compared to connection means without a zinc coating.

In an even further preferred embodiment according to the invention, the method further comprises the step of providing zinc to the surface prior to the step of providing a zinc surface in the housing and the step of taking out the zinc surface of the housing after the heating step. Hence, it is feasible that the patination is performed within the same housing as the zinc coating. However, it is also feasible that the patination occurs in a different housing than the zinc coating. For instance, the patination may occur on site.

An extra effect of the method according to the invention is that the (metal) surface can be zinc coated and therefore renders it possible to provide an equal layer of zinc to the (metal) surface. Furthermore, the (metal) surface can be equipped before the patination process is performed. This will result in an efficient and effective method for patinating zinc surfaces.

In an even further preferred embodiment according to the invention, the housing is container configured to contain the patinated zinc surface. The container preferably forms an enclosure for the atmosphere and is more preferably substantially closed (i.e. except on any ingress and outgress). However, in an alternatively embodiment, the container has apertures to its environment. In the latter embodiment, it is preferred that carbon based gas and humidity are continuously added so as to maintain the composition of the atmosphere within a desired range.

An advantage of the method according to the invention is that the patination process can be performed on site. As a result, maintenance of the zinc surface is more efficient and effective due to the fact that less assembly (during use) and/or transport is required. This also positively influence the environment as less traveling with parts is required.

In an even further preferred embodiment according to the invention, the method further comprises the step of analysing the patinated surface.

In again a further embodiment, the structural element is a condenser element of an evaporative condenser or closed circuit cooler. This may be part of a cooling tower. Preferably, the method therein comprises the step of installing an evaporative condenser element with a zinc surface within a housing of the object, such as a condenser or closed circuit cooler in a cooling tower. This installation step may be carried out either before patination, wherein the patination is performed on site, or after patination.

It will be understood that an evaporative condenser may refer to a gas condenser, wherein the gas condenser condenses gas forming a liquid, and/or a liquid cooler, wherein the liquid cooler cools liquid.

An advantage of the method according to the invention is that analysing the patinated surface provides information about the quality, such as conciseness, homogeneity, packing and/or uniformity of the patina layer. This results in a good knowledge of the patina layer, for example where the weak spots are.

A further advantage of the method according to the invention is that the quality and/or thickness of the patina layer can be analysed. This results in a predictability of maintenance and thus in a longer lasting patina layer and/or patinated surface.

Installing the evaporative condenser with a zinc surface in a closed circuit cooling tower has the advantage that an effective and efficient closed circuit cooling tower is achieved.

The invention also relates to a patinated evaporative condenser in a closed circuit cooling tower, the evaporative condenser comprises steel, zinc, and zinc carbonate, and wherein the evaporative condenser is patinated by the method according to the invention.

The patinated evaporative condenser in a closed circuit cooling tower provides the same effects and advantages as the method according to the invention. Furthermore, there has been a long felt need for an evaporative condenser whit long lasting anti-corrosion effect.

Besides an evaporative condenser other objects can be patinated, not being limited by theory, all the objects patinated and/or passivated by traditional methods can be patinated by the method according to the invention. For example, but not limited to, lampposts, post boxes, rain pipe, gutter, pipes, fences, concrete braiding, and the like.

The invention also relates to a system for patinating zinc surfaces, comprising:

- a housing;
- an ingress/egress to open the housing;
- an ingress for gas which is operatively coupled with the housing;
- an ingress for water vapour which is operatively coupled with the housing; and
- a heating element to heat the gas, wherein the system is configured to perform the method according to the invention.

The system according to the invention provides the same effects and advantages as the method according to the invention and the patinated evaporative condenser in a closed circuit cooling tower according to the invention.

An extra effect of the system according to the invention is that patinating zinc surfaces can be performed on site. This results in an effective and efficient system.

In a preferred embodiment according to the invention, the system further comprises an egress for water vapour which is operatively coupled with the housing and/or an egress for gas which is operatively coupled with the housing, and the system further comprises a sensor configured for measuring different gas concentrations and/or for measuring the humidity in the housing.

An advantage of the system according to the invention is that the gas composition can be measured and tuned accordingly. This will result in a well defined and stable climate which is required to form a uniform and/or homogeneous patina layer and effective patination.

In a further preferred embodiment according to the invention, wherein the heating element is switched on for at least two hours, preferably the heating element is switched on for at least three hours, more preferably the heating element is switched on for at least four hours.

It was found that switching on the heating element for at least two hours, preferably for at least three hours, and more preferably for at least four hours provided an efficient and effective patination layer.

In a further preferred embodiment according to the invention, the system comprises analysing means to analyse the patinated surface. Preferably, the system further comprises an evaporative condenser with a zinc surface in a closed circuit cooling tower within the housing.

The analysing means, such as an infrared spectrometer or microscopy, has the advantage that the patinated surface may be analysed continuously. As a result, the weak spots will be identified before the system breaks down and that the patinated surface may be analysed before the system is in use.

Placing an evaporative condenser within the housing results in a closed system for cooling, such as a cooling tower. The cooling tower requires less maintenance as weak spots, such as connections, are patinated at the place where it is used. Therefore, a more robust system is achieved.

The method and/or system are also suitable for patinating a (metal) surface comprising a zinc alloy rather than pure zinc. Preferably, in case of a zinc alloy, the content of zinc in the alloy is at least 40 wt %, more preferably the content of zinc in the alloy is at least 60 wt %, even more preferably the content of zinc in the alloy is at least 80 wt %. These metals provides the same effects and advantages as the method according to the invention, the patinated evaporative condenser in a cooling tower according to the invention, the system according to the invention and sensor/analyser according to the invention.

The invention also relates to a patinated product obtainable by the method according to the invention.

The patinated product according to the invention provides the same effects and advantages as the method and system according to the invention.

The patinated product can be for example but not limited to, lampposts, post boxes, rain pipe, gutter, pipes, fences, concrete braiding, and the like.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION

Figure 1:
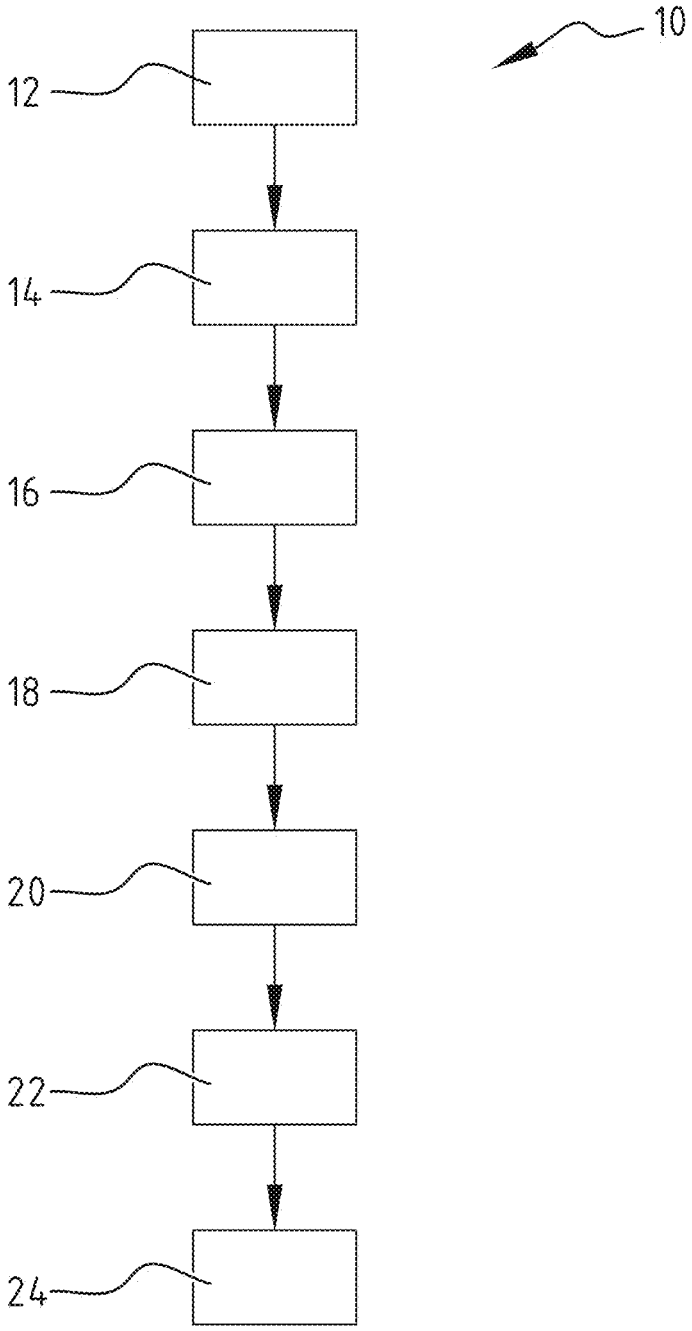
FIG. 1 shows a schematic overview of the method according to the invention.

Method 10 (FIG. 1) comprises the steps of providing zinc to the structural element with a surface 12, providing a structural element with a zinc surface in a housing 14, optionally the step of providing a structural element with a zinc surface to an object of the application can be applied, providing the housing with a carbon based gas and humidity 16, heating the zinc surface for at least one hour 18, wherein the heating occurs at a temperature of at least 50° C., the humidity is at least 70% and the carbon based gas concentration is at least 5% by volume. Furthermore, method 10 comprises the steps of taking out the zinc surface from the housing 20, preferably analysing the patinated surface 22 and even more preferably installing an evaporative condenser with a zinc surface in a closed circuit cooling tower 24.

It will be understood that the step of analysing the patinated surface 22 can also be performed before the step of taking out the zinc surface of the housing 20. Furthermore, it will be understood that combinations of the various steps are possible to. For example, the step of installing an evaporative condenser with a zinc surface in a closed circuit cooling tower 24 is optional.

Figure 2:
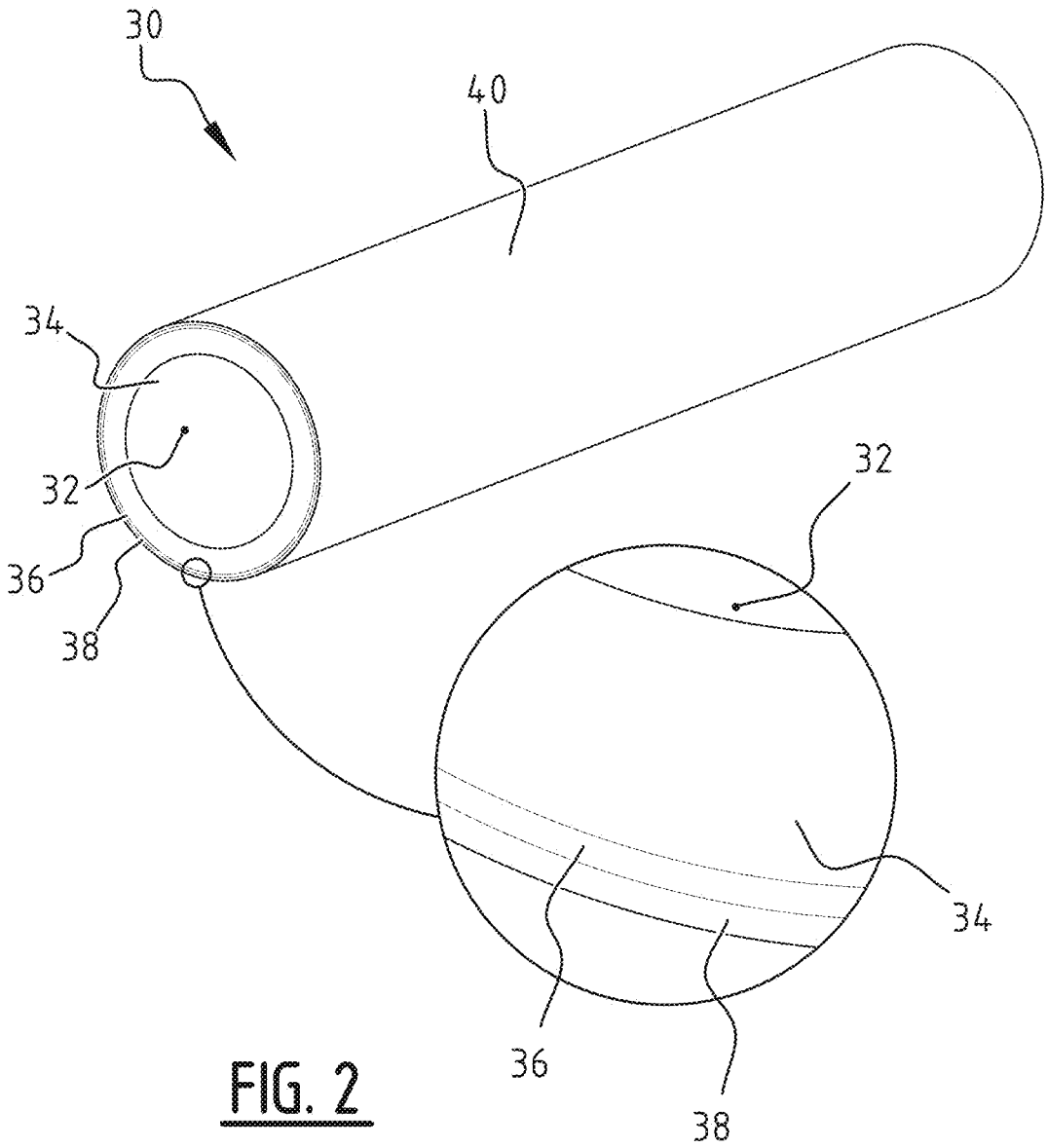
FIG. 2 shows a pipe comprising the different layers.

Pipe 30 (FIG. 2), comprises inside 32 of steel pipe 34, zinc coating 36 and patina layer 38. Outside 40 of pipe 30 is covered with patina layer 38.

In a preferred embodiment all objects patinated and/or passivated by traditional methods can be patinated by the method according to the invention. For example, but not limited to, lampposts, post boxes, rain pipe, gutter, pipes, fences, concrete braiding, and the like.

In a preferred embodiment the method and/or system are also suitable for patinating a (metal) surface comprising another coating then zinc, for example, copper, bronze, lead, and the like.

Figure 3:
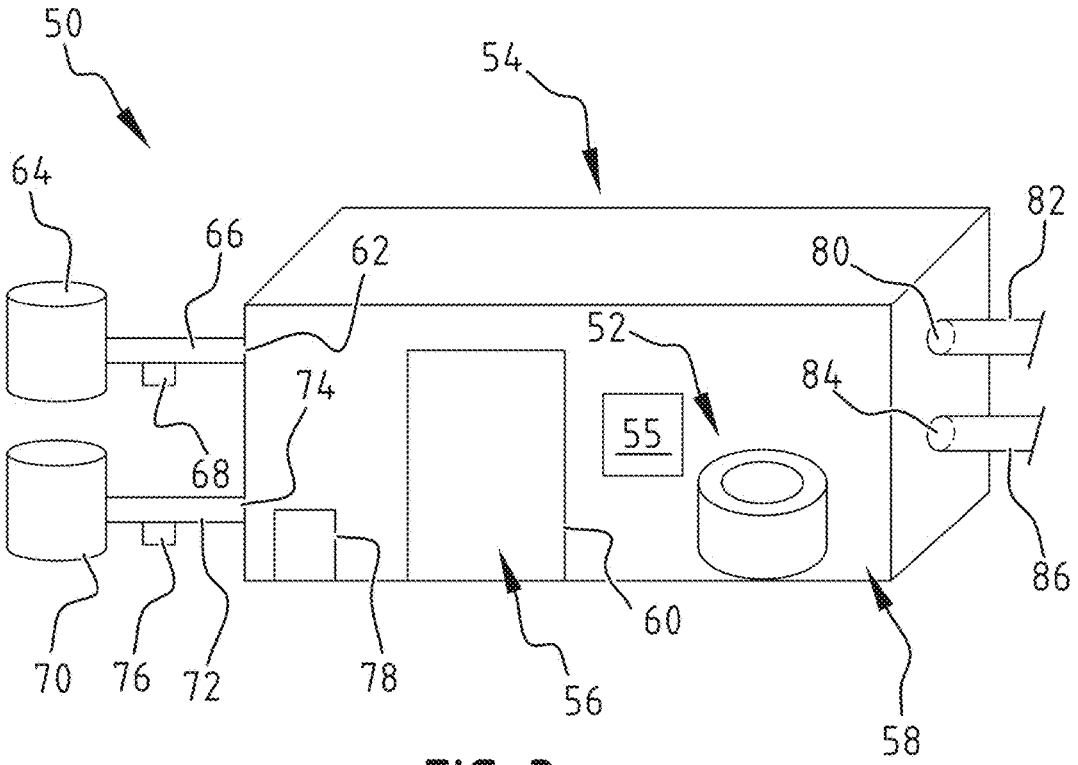
FIG. 3 shows a schematic system for patinating zinc surfaces of a structural element.

System 50 (FIG. 3) is suitable for patinating zinc surfaces of structural element 52. System 50 comprises container 54 which is configured to have a substantially open configuration and a substantially closed configuration. In the substantially closed configuration, the container is configured to house structural element 52 comprising a zinc surface, such as an evaporative condenser with a zinc surface in a closed circuit cooling tower. The atmosphere in container 54 may be heated so that structural element 52 is also heated. Preferably, the atmosphere comprises a carbon-based gas and humidity, which may be continuously added to container 54. Container 54 further comprises analysing means 55, to analyse the patination layer.

Container 54 may further comprise entrance 56, wherein entrance 56 is configured to access inside 58 of container 54. Preferably the dimensions of entrance 56 have dimensions which are suitable to move structural element 52 from inside 58 of container 54 to the outside of container 54. Entrance 56 further comprises sealing means 60 to seal the entrance. Sealing means 60 are configured to seal the atmosphere inside 58 from the outside.

The container further comprises ingress 62 for allowing carbon-based gas to enter container 54. Tank 64 provides the carbon-based gas via conduit 66 to inside 58 of container 54. Heating element 68 may be operatively coupled to tank 64 and/or conduit 66 and/or ingress 62 to heat the carbon-based gas before it enters container 54.

System 50 further comprises tank 70, wherein tank 70 is configured to hold water vapour, or other forms thereof. Tank 70 is operatively coupled via conduit 72 and ingress 74 with inside 58 of container 54. The water vapour, or other form thereof, may be heated by heating element 76.

System 50 further comprises heating element 78 which may heat the atmosphere inside container 54.

System 50 optionally comprises gas egress 80, which is operatively connected to system gas exit 82, and water vapour egress 84 which is operatively connected to system water vapour exit 86.

Figure 4:
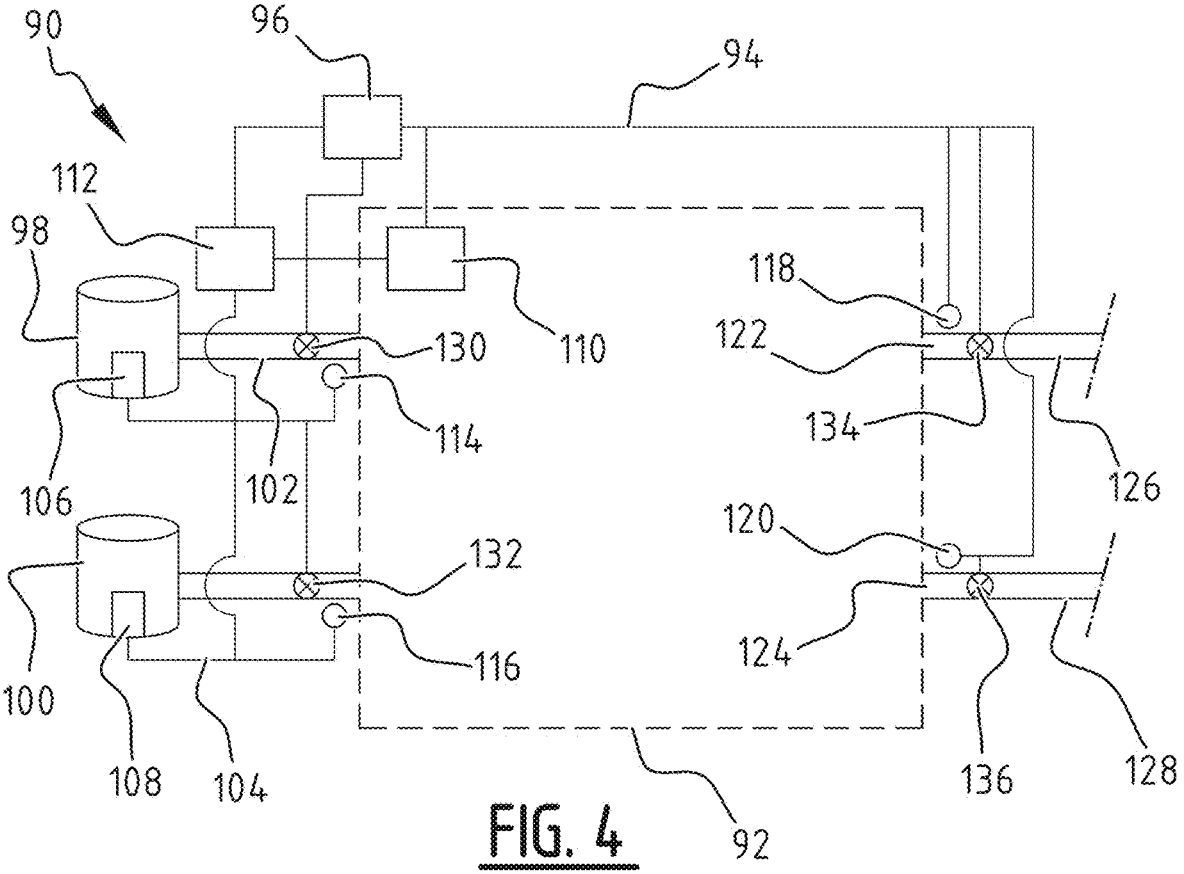
FIG. 4 shows a schematic system comprising the main electrical components of the system for patinating zinc surfaces of a structural element.

System 90 (FIG. 4) shows a schematic overview of the main electrical components of a system for patinating a zinc surface, wherein container 92 comprises the zinc surface. The main electrical components of system 90 are operatively connected via conductors 94. Central processing unit 96 is configured for controlling the flow of water vapour and carbon-based gas into container 92. Central processing unit 96 may include a computing device.

System 90 further comprises tank 98 and 100 which are configured for storing either the carbon-based gas or water vapour or the like and are operatively coupled with container 92 via respectively conduit 102 or conduit 104. System 90 further comprises heating elements 106, 108 and 110 which are configured for heating the atmosphere within tank 98, tank 100 and container 92.

System 90 is provided with power via power supply 112, which is operatively coupled to heating elements 106, 108 and 110, central processing unit 96, and other electrical components of system 90.

System 90 further comprises sensors 114, 116, 118 and 120 which operatively coupled with central processing unit 96, to provide information about the patinating process within container 92 for controlling system 90. Sensors 114, 116, 118, 120 may comprise a sensor for determining the carbon-based gas within the atmosphere, determining the relative humidity, determining the temperature, determining the gas flow, and the like.

System 90 further comprises egress 122 and egress 124 which are part of container 92 and operatively couple gas exit 126 and water vapour exit 128 with container 92.

Conduit 102, conduit 104, gas exit 126, water vapour exit 128 comprises respectively valve 130, 132, 134, 136. Valve 130, 132, 134, 136 can close or open the respective conduit or exit. The valves are operatively coupled with central processing unit 96.

In an experiment performed with the method according to the invention, a steel surface which is zinc coated was patinated. The surface used was a zinc coated steel pipe comprising a diameter of 10 centimetre and a length of 10 centimetre. The surface was exposed to different carbon dioxide concentrations at a temperature between 53° C. and 57° C. for approximately three hours. The RH was determined every 30 minutes. The corrosion was determined by exposing the surface to a saturated oxygen solution of 150 mg $Cl^-$/L for 24 hours. The results are shown in the Table 1, wherein $CO_2$% is the carbon dioxide concentration, T is the temperature in degrees Celsius (° C.), RH is relative humidity, SD is the standard deviation of RH, and result is the overall results of the pipes exposed to corrosion.

TABLE 1 results of patination process with different carbon dioxide concentrations.

| Entry | $CO_2$ % | T [° C.] | RH [%] | SD | Result |
|---|---|---|---|---|---|
| 1 | atmosphere | 56 | 65 | 15.7 | white rust |
| 2 | 1 | 57 | 67 | 13.9 | Good |
| 3 | 5 | 55 | 54 | 11.3 | very good |
| 4 | 10 | 54 | 50 | 7.0 | very good |
| 5 | 20 | 53 | 60 | 10.2 | very good |

Increasing the concentration of carbon dioxide shows good patination of the surface, and thus protection against corrosion. Concentrations in the range of 15% to 30% of carbon dioxide, and preferably above 20% of carbon dioxide were considered undesired as high concentrations of carbon dioxide are hazardous, and not cost effective.

It is shown that a concentration of at least 5% carbon dioxide provides the zinc coated metal surface with a very good patina layer. This will result in a longer lasting protection for corrosion.

Figure 5:
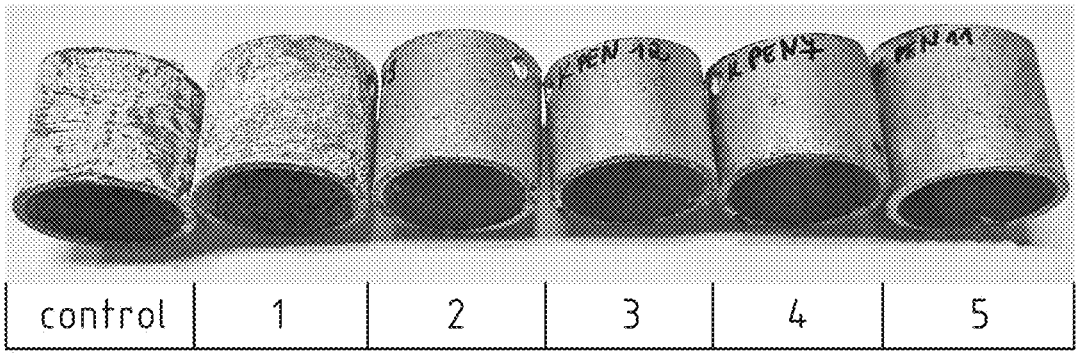
FIG. 5 shows pipes exposed to different carbon dioxide concentrations.

In a further experiment performed with the method according to the invention, steel pipes were exposed to the conditions mentioned in table 1 (FIG. 5). Thus, control is the pipe exposed to a gas without any carbon dioxide, pipe one was exposed to a carbon dioxide concentration present in outside air, pipe two was exposed to a gas with a carbon dioxide concentration of about 1%, pipe three was exposed to a gas with a carbon dioxide concentration of about 5%, pipe four was exposed to a gas with a carbon dioxide concentration of about 10%, and pipe five was exposed to a gas with a carbon dioxide concentration of about 20%.

It becomes clear that a severe, efficient and effective patination layer is formed on the zinc coated surface of the pipes.

FIGS. 6A-D show IR spectra of analysed zinc patinated products. The IR spectra relate to the patinated zinc surface, wherein the surface it patinated over different times under the conditions of 20% $CO_2$ gas at 60° C. The different times are 24 hours, 12 hours, 6 hours, and 3 hours, for respectively FIGS. 6A, 6B, 6C, and 6D. To prepare the samples, 10 to 100 μg of the patination layer was removed from the patinated surface using a binocular microscope under flat lighting. The obtained powder was grinded in a monocrystalline sapphire mini-mortar in the presence of cesium bromide. After hydrolic compression pellets of 5 mm in diameter were obtained.

The x axis of the spectra includes wavenumber ($cm^{-1}$) and the y-axis includes the absorbance (A).

The pellets were analysed using an infrared absorption spectrometer, Fourier Perkin Elmer Frontier which was able to operate in the far infrared up to 200 $cm^{-1}$. For each of the samples a global spectrum over 4000200 $cm^{-1}$ was obtained. The pellets were then calcinated at 550° C. for about 30 minutes and reconstituted before analysis.

Figure 6A:
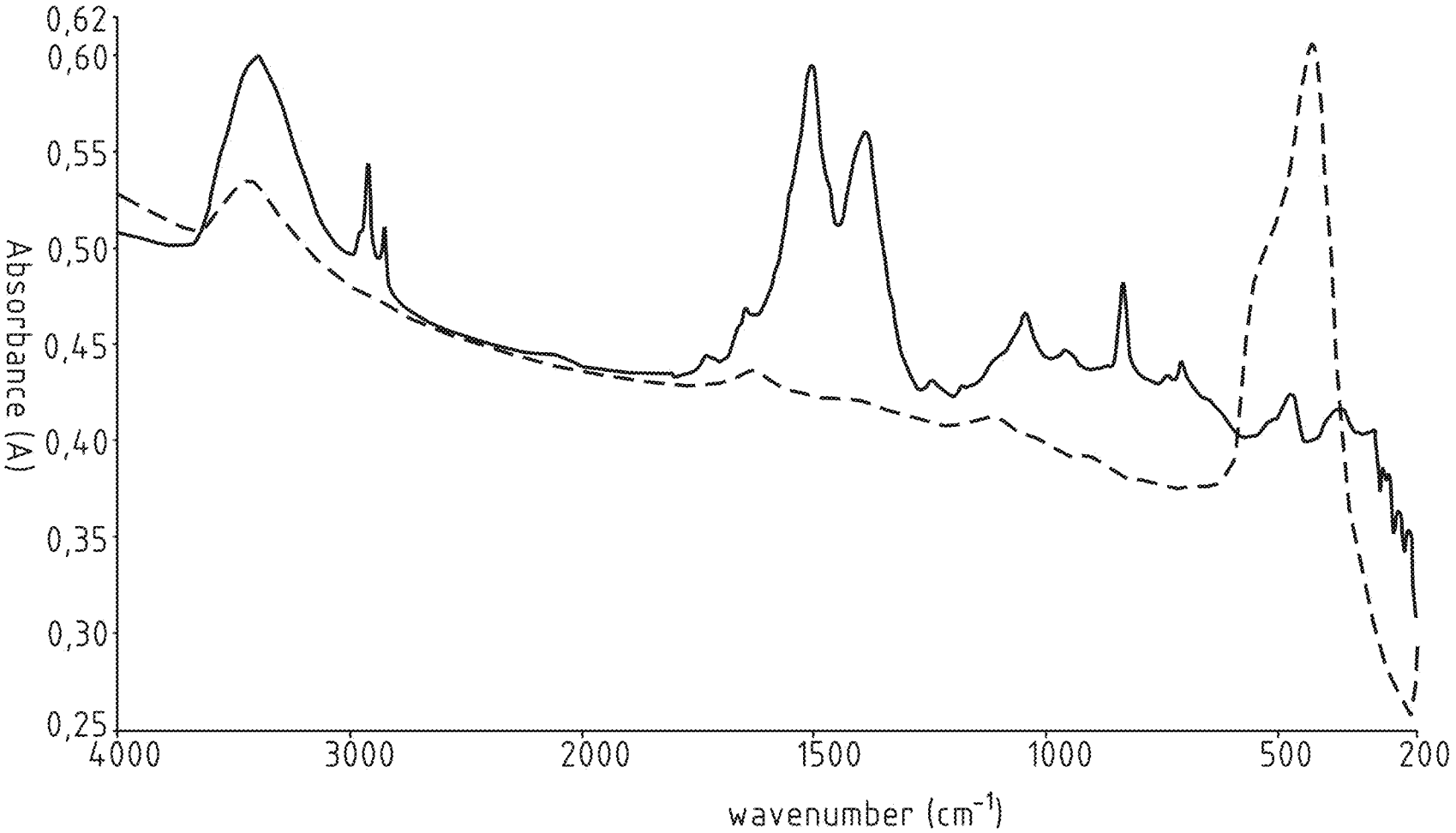
FIGS. 6A, 6B, 6C and 6D show IR spectra of analysed zinc patinated products.

FIG. 6A shows the IR spectra of the collected patination layer before and after calcination. The IR spectrum before calcination, top line at 1500 $cm^{-1}$, shows hexahydroxydicarbonate pentazinc (HCPZ) of medium crystallinity. The peaks at 1647, 1505, 1390, 1045, 957, 834, 739, 708, and 468 $cm^{-1}$ relate to HCPZ. The peak at 3398 $cm^{-1}$ is slightly shifted compared to the expected result (3420 $cm^{-1}$). Therefore, this peak is more relevant to the hydration of the product than to the characterisation of OH of HCPZ. Furthermore, it becomes clear that there is a significant pollution (peaks at 2957, 2923, and 2852 $cm^{-1}$). This pollution is related to the analysed product rather than to operational pollution. Therefore, the spectrum after calcination where only this pollution may be present (lower line at 1500 $cm^{-1}$).

After calcination there is only one peak with shoulder related to HCPZ present at 425 $cm^{-1}$. This peak relates to calcinated HCPZ in the form of zinc oxide. Due to the presence of small amounts of pollution the crystallisation of zinc oxide was disturbed and pollutions were incorporated within the crystal structure. The pollutions are silica and/or phosphate based molecules. The small peak at 1109 $cm^{-1}$ relates to such pollution. The peaks at 3434 and 1634 $cm^{-1}$ are related to water which was hydroscopically attracted by the sample.

Figure 7:
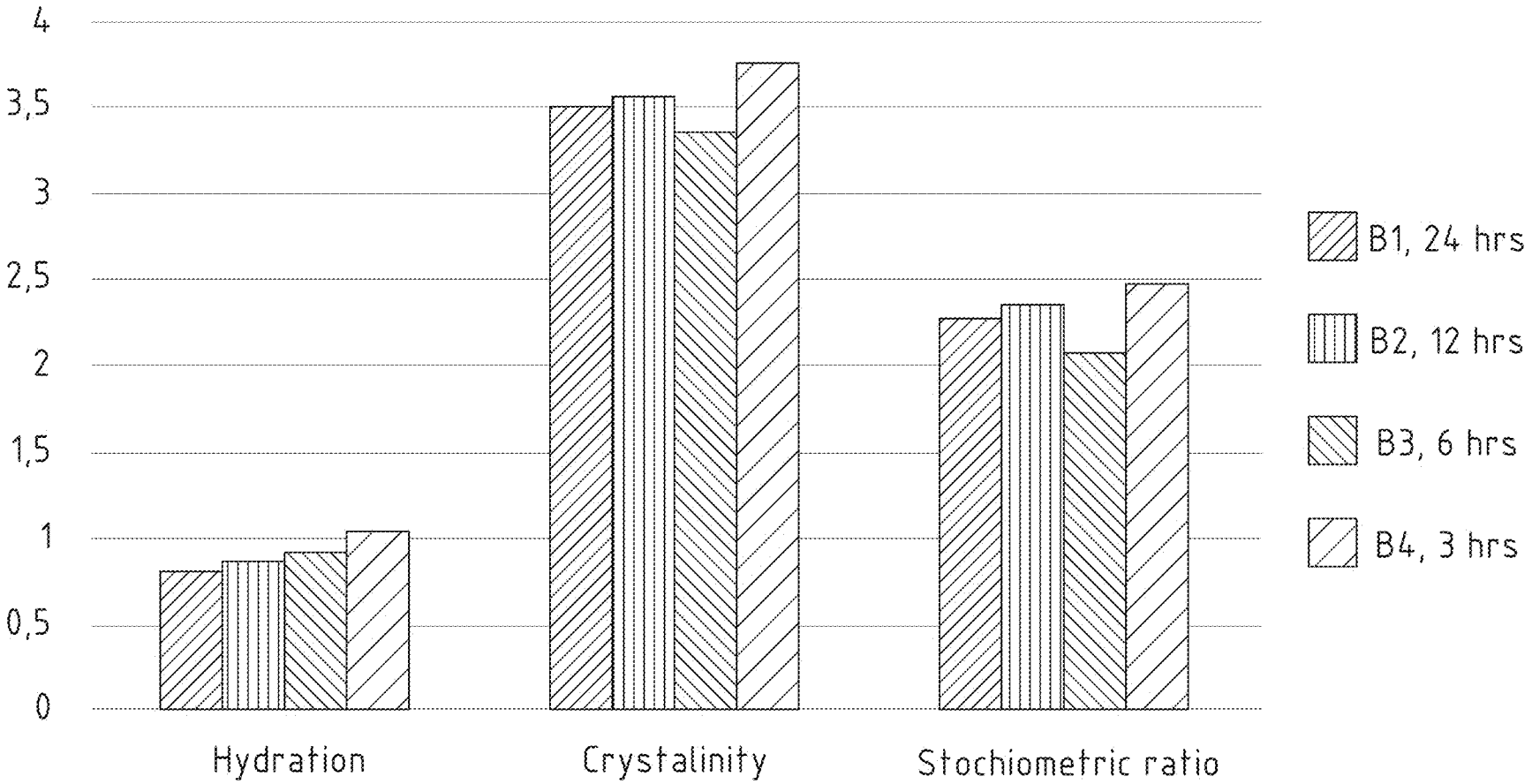
FIG. 7 shows the results of the IR analysis of a zinc patinated product according to the invention.

It was found that the hydration factor is 0.81, the crystallinity factor is 3.51, and the stoichiometric ratio is 2.28 (FIG. 7).

Figure 6B:
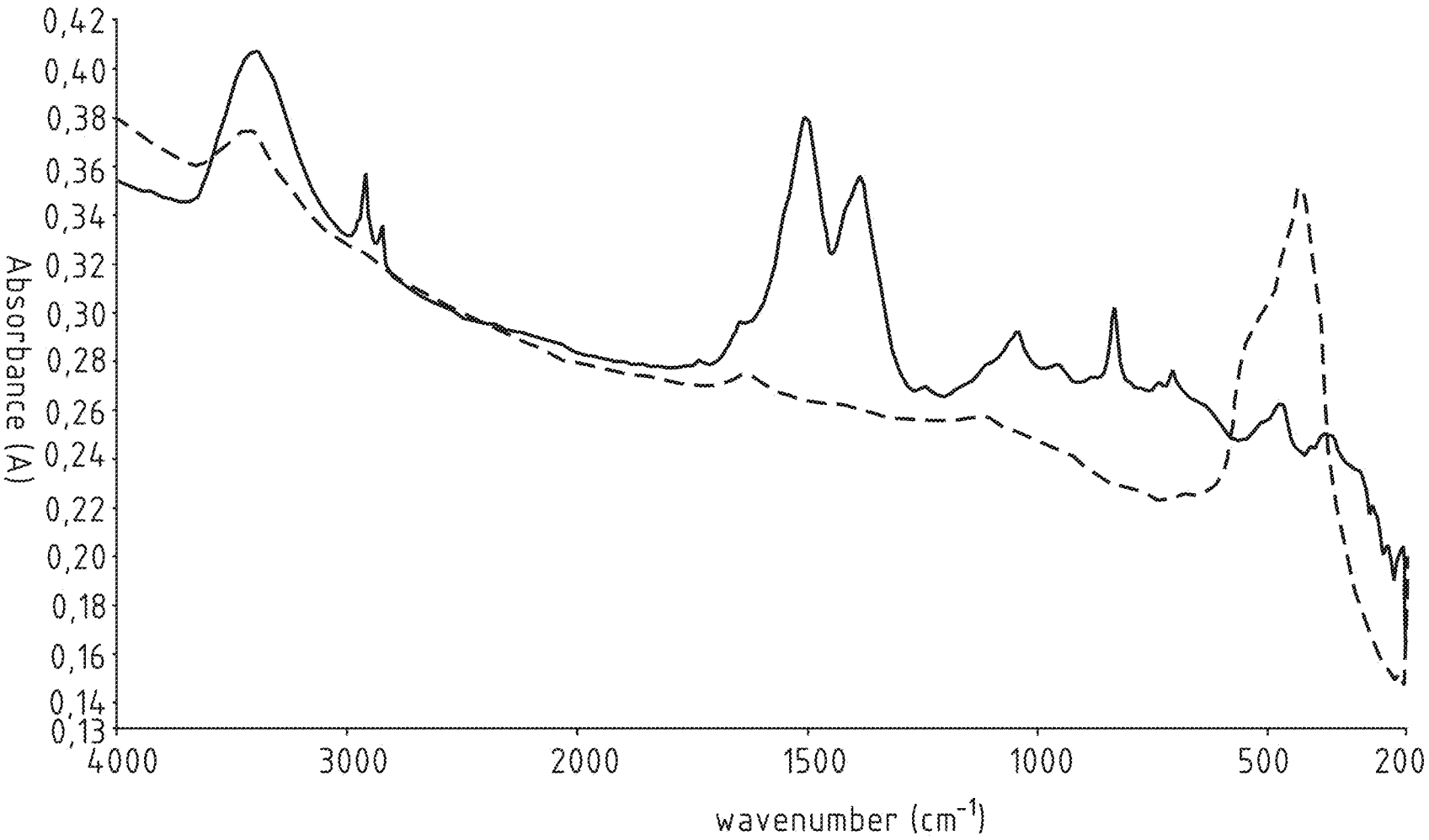

FIG. 6B shows the IR spectra of the collected patination layer before and after calcination. The IR spectrum before calcination, top line at 1500 $cm^{-1}$, shows HCPZ of medium crystallinity. The peaks at 1646, 1504, 1388, 1046, 960, 834, 738, 708, and 473 $cm^{-1}$ relate to HCPZ. The peak at 3399 $cm^{-1}$ is slightly shifted compared to the expected result (3420 $cm^{-1}$). Therefore, this peak is more relevant to the hydration of the product than to the characterisation of OH of HCPZ. Furthermore, it becomes clear that there is a significant pollution (peaks at 2958, 2924, and 2854 $cm^{-1}$). This pollution is related to the analysed product rather than to operational pollution. Therefore, the spectrum after calcination where only this pollution may be present (lower line at 1500 $cm^{-1}$).

After calcination there is only one peak with shoulder related to HCPZ present at 427 $cm^{-1}$. This peak relates to calcinated HCPZ in the form of zinc oxide. Due to the presence of small amounts of pollution the crystallisation of zinc oxide was disturbed and pollutions were incorporated within the crystal structure. The pollutions are silica and/or phosphate based molecules. The small peak at 1114 $cm^{-1}$ relates to such pollution. The peaks at 3435 and 1643 $cm^{-1}$ are related to water which was hydroscopically attracted by the sample.

It was found that the hydration factor is 0.87, the crystallinity factor is 3.55, and the stoichiometric ratio is 2.35 (FIG. 7).

Figure 6C:
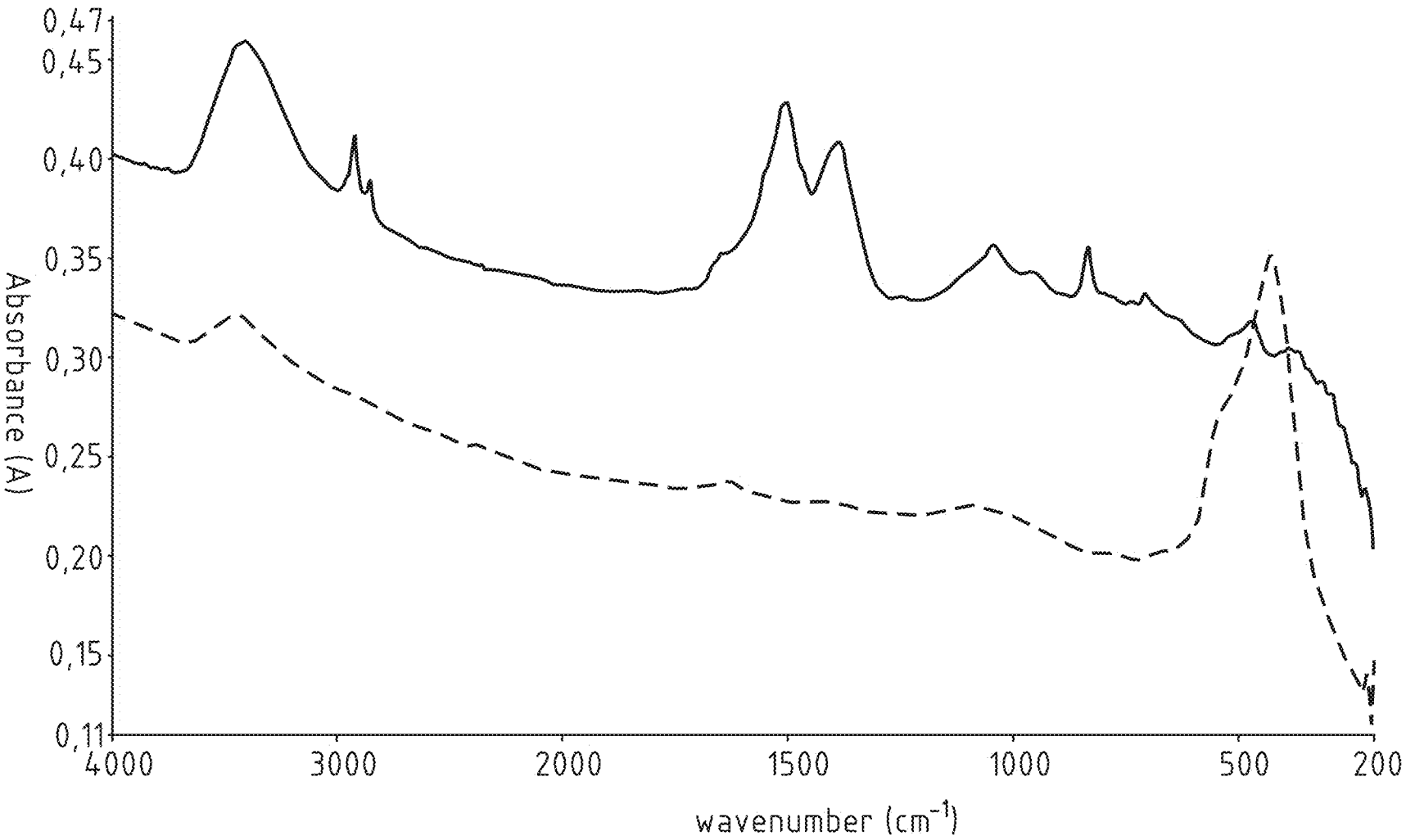

FIG. 6C shows the IR spectra of the collected patination layer before and after calcination. The IR spectrum before calcination, top line at 1500 $cm^{-1}$, shows HCPZ of medium crystallinity. The peaks at 1646, 1504, 1389, 1045, 960, 834, 737, 708, and 473 $cm^{-1}$ relate to HCPZ. The peak at 3401 $cm^{-1}$ is slightly shifted compared to the expected result (3420 $cm^{-1}$). Therefore, this peak is more relevant to the hydration of the product than to the characterisation of OH of HCPZ. Furthermore, it becomes clear that there is a significant pollution (peaks at 2956, 2924, and 2854 $cm^{-1}$). This pollution is related to the analysed product rather than to operational pollution. Therefore, the spectrum after calcination where only this pollution may be present (lower line at 1500 $cm^{-1}$).

After calcination there is only one peak with shoulder related to HCPZ present at 425 $cm^{-1}$. This peak relates to calcinated HCPZ in the form of zinc oxide. Due to the presence of small amounts of pollution the crystallisation of zinc oxide was disturbed and pollutions were incorporated within the crystal structure. The pollutions are silica and/or phosphate based molecules. The small peak at 1109 $cm^{-1}$ relates to such pollution. The peak at 3437 $cm^{-1}$ is related to water which was hydroscopically attracted by the sample.

It was found that the hydration factor is 0.92, the crystallinity factor is 3.35, and the stoichiometric ratio is 2.07 (FIG. 7).

Figure 6D:
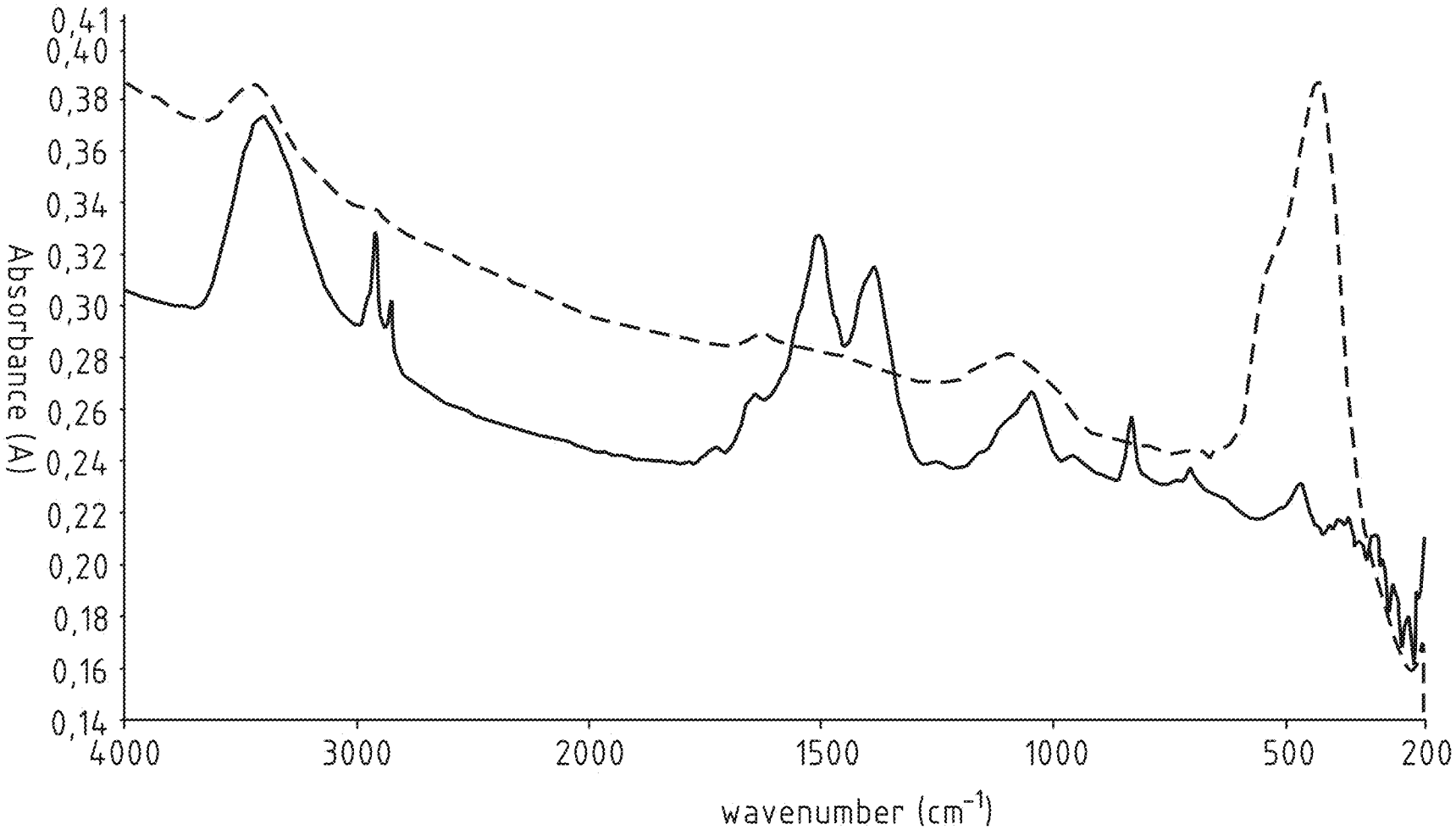

FIG. 6D shows the IR spectra of the collected patination layer before and after calcination. The IR spectrum before calcination, top line at 1500 $cm^{-1}$, shows HCPZ of medium crystallinity. The peaks at 1646, 1502, 1388, 1047, 960, 835, 706, and 469 $cm^{-1}$ relate to HCPZ. The peak at 3400 $cm^{-1}$ is slightly shifted compared to the expected result (3420 $cm^{-1}$). Therefore, this peak is more relevant to the hydration of the product than to the characterisation of OH of HCPZ. Furthermore, it becomes clear that there is a significant pollution (peaks at 2958, 2923, and 2853 $cm^{-1}$). This pollution is related to the analysed product rather than to operational pollution. Therefore, the spectrum after calcination where only this pollution may be present (lower line at 1500 $cm^{-1}$).

After calcination there is only one peak with shoulder related to HCPZ present at 429 $cm^{-1}$. This peak relates to calcinated HCPZ in the form of zinc oxide. Due to the presence of small amounts of pollution the crystallisation of zinc oxide was disturbed and pollutions were incorporated within the crystal structure. The pollutions are silica and/or phosphate based molecules. The broad peak at 1109 $cm^{-1}$ relates to such pollution. The peaks at 3458 and 1629 $cm^{-1}$ are related to water which was hydroscopically attracted by the sample.

It was found that the hydration factor is 1.05, the crystallinity factor is 3.74, and the stoichiometric ratio is 2.47 (FIG. 7).

FIG. 7 shows the results of the IR analysis (FIGS. 6A-6D) of a zinc patinated product according to the invention. The left set of four bars corresponds to the hydration, the middle set of four bars corresponds to the crystallinity, and the right set of four bars corresponds to the stoichiometric ratio. The left bar corresponds with a patination time of 24 hours, the second from the left bar corresponds with a patination time of 12 hours, the second from the right bar corresponds with a patination time of 6 hours, and the right bar corresponds with a patination time of 3 hours. It becomes clear that HCPZ provide effective and efficient protection, wherein the build up of the tight layers prevent further growth of the layer thickness and therefore an efficient and effective patinated surface is achieved.

Furthermore, it becomes clear that the crystallinity and stoichiometric ratio of the sample patinated for 6 hours is not in line with the expected results. This is due to a discontinuity of the patination time.

FIGS. 8A-8D show SEM-EDX analysis of the patination process at various stages according to the invention in relation to a conventional method.

Figure 8A:
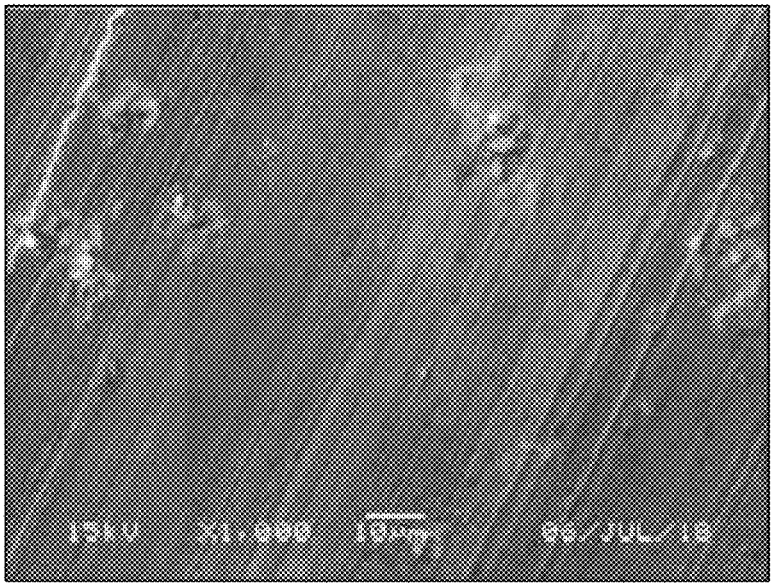
FIGS. 8A, 8B, 8C, and 8D show SEM-EDX analysis of the patination process at various stages.

FIG. 8A shows a fresh zinc surface without any treatment. The composition of the surface is about 79% Zn and about 21% O.

Figure 8B:
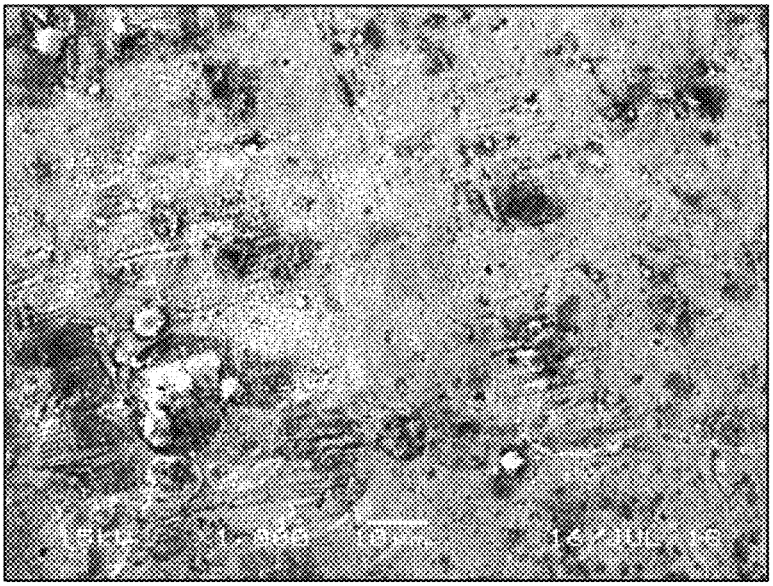

FIG. 8B shows a patination layer, wherein the zinc surface of FIG. 8A is treated with the method according to the invention for about 30 minutes. The composition of the surface is about 11% C, about 65% Zn, about 24% O, and traces of other elements such as Al, Pb, and Si.

Figure 8C:
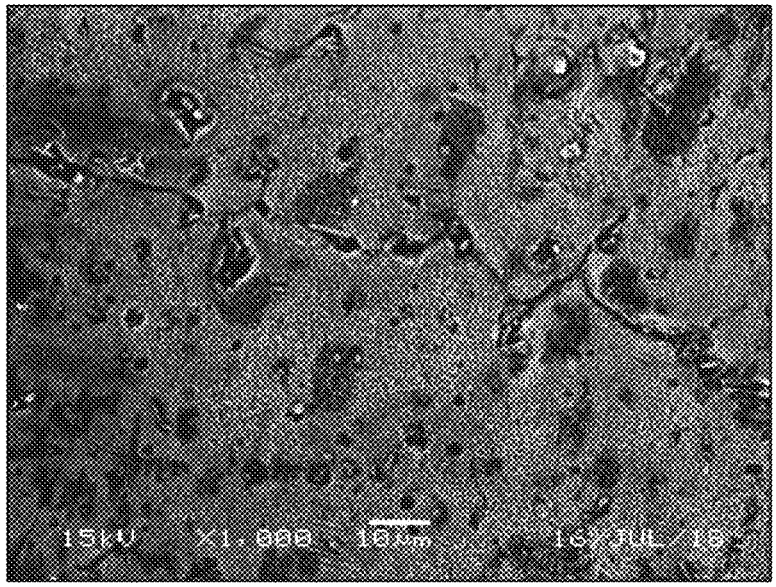

FIG. 8C shows a patination layer, wherein the zinc surface of FIG. 8A is treated with the method according to the invention for about 7 hours. The composition of the surface is about 9% C, about 62% Zn, about 28% O, and traces of other elements such as Al and Pb.

Figure 8D:
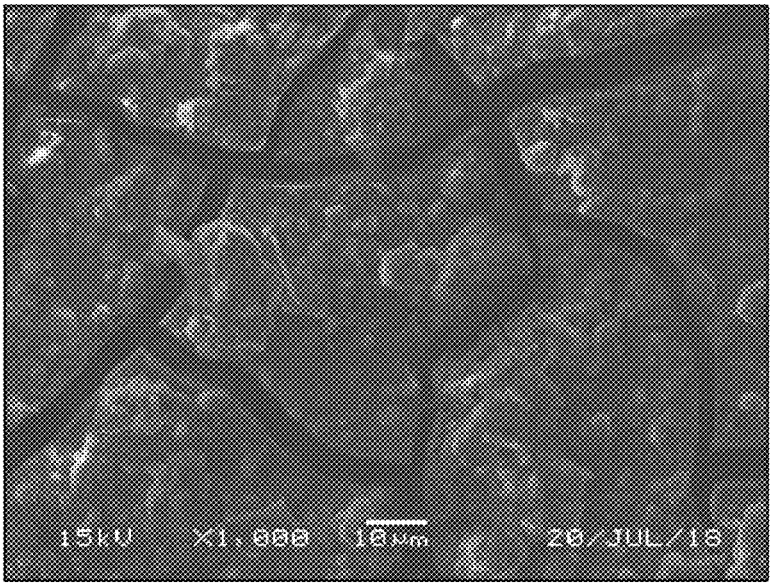

FIG. 8D shows a patination layer, wherein the zinc surface of FIG. 8A is passivated with a conventional method by placing the zinc surface outside in Zelhem (Netherlands)

for about six weeks between April and May. The composition of the surface is about 6% C, about 0.5% Zn, about 52% O, about 27% Ca, about 13% P, about 1.8% Mg, and traces of Si.

FIGS. 8A-8D show that a quick patination layer can be provided to a zinc surface. Furthermore, FIG. 8D comprises cracks in the passivation layer. The cracks are weak places and the metal can be oxidised quickly. The method according to the invention provides thin and hard patination layers without cracks (FIG. 8C). Therefore, the method according to the invention results in a more sustainable protection layer.

The experiments clearly shows the advantageous effects achieved with the method and system of the invention.

The present invention is by no means limited to the above described preferred embodiments thereof. The rights sought are defined by the following claims, within the scope of which many modifications can be envisaged.

What is claimed is:

1. A method for patinating zinc surfaces of a structural element, comprising:

providing the structural element with a zinc surface in a housing comprising at least two ingresses for allowing an atmosphere to enter the housing, the at least two ingresses comprising a gas ingress for allowing gas to enter the housing and a water vapor ingress for allowing water vapor to enter the housing;

providing the atmosphere around the zinc surface, wherein said atmosphere comprises carbon based gas and humidity; and heating the zinc surface for at least 2 hours, to provide a patinated zinc surface;

wherein the heating of the zinc surface occurs by heating the atmosphere to a temperature of at least 50° C., the humidity is at least 70%, and a carbon based gas concentration is at least 5% by volume.

2. The method of claim 1, wherein the carbon based gas is selected from the group consisting of carbon dioxide, carbon monoxide, and mixtures thereof.

3. The method of claim 1, wherein the carbon based gas concentration is at least 10% by volume.

4. The method of claim 1, wherein the carbon based gas concentration is from 15% to 30% by volume.

5. The method of claim 1, wherein the heating occurs at a temperature of at least 60° C.

6. The method of claim 1, wherein the heating occurs at a temperature of at least 80° C.

7. The method of claim 1, wherein the humidity is at least 75%.

8. The method of claim 1, further comprising the step of providing zinc to the zinc surface prior to the step of providing the zinc surface in the housing.

9. The method of claim 1, further comprising the step of taking out the zinc surface of the housing after the heating the zinc surface step.

10. The method of claim 1, wherein the housing is a frame or container configured to contain the patinated zinc surface.

11. The method of claim 1, further comprising the step of analysing the patinated zinc surface using an infrared absorption spectrometer.

12. The method of claim 1, further comprising the step of installing an evaporative condenser with the zinc surface in a closed circuit cooling tower.

13. The method of claim 1 further comprising providing a patina layer having a uniform and homogeneous structure comprising penta zinc hydroxy di carbonate having a structural formula of $Zn_5(CO_3)_2 \cdot (OH)^-_6$.

14. A method for patinating zinc surfaces of a structural element, comprising:

providing the structural element with a zinc surface in a housing comprising at least two ingresses for allowing an atmosphere to enter the housing, the at least two ingresses comprising a gas ingress for allowing gas to enter the housing and a water vapor ingress for allowing water vapor to enter the housing;

providing the atmosphere around the zinc surface, wherein said atmosphere comprises carbon based gas and humidity; and heating the zinc surface for at least one hour, to provide a patinated zinc surface;

wherein the heating of the zinc surface occurs by heating the atmosphere to a temperature of at least 80° C., the humidity is at least 70%, and a carbon based gas concentration is at least 5% by volume.

* * * * *